US006945451B1

(12) United States Patent
Bridges

(10) Patent No.: US 6,945,451 B1
(45) Date of Patent: Sep. 20, 2005

(54) MAIL RECEPTACLE FOR ATTACHING TO A PERIPHERY OF A MAIL SLOT OF A DOOR

(76) Inventor: Earl Bridges, 4675 Evans Ave., St. Louis, MO (US) 63113-2315

( * ) Notice: Subject to any disclaimer, the term of this patent is extended or adjusted under 35 U.S.C. 154(b) by 0 days.

(21) Appl. No.: 10/218,126

(22) Filed: Aug. 13, 2002

(51) Int. Cl.[7] ..... A47G 29/12
(52) U.S. Cl. ..... 232/19; 232/45; 70/4
(58) Field of Search ..... 232/19–21, 45, 232/43.1, 1 E; 109/67, 68, 19; 220/476; 49/68; 70/4, 7

(56) References Cited

U.S. PATENT DOCUMENTS

| | | | | |
|---|---|---|---|---|
| 359,458 A | | 3/1887 | Moore | |
| 449,593 A | * | 3/1891 | Scott | 232/19 |
| 757,698 A | * | 4/1904 | Warner | 232/45 |
| 1,805,393 A | * | 5/1931 | Fancier | 232/20 |
| 3,590,607 A | * | 7/1971 | Beaver | 70/206 |
| 3,828,591 A | * | 8/1974 | Beaver | 70/56 |
| 4,069,965 A | | 1/1978 | Maddox, Jr. | |
| 4,776,512 A | | 10/1988 | Moore, Sr. et al. | |
| 4,815,656 A | | 3/1989 | Smith et al. | |
| 4,826,075 A | | 5/1989 | Burns | |
| 5,082,169 A | | 1/1992 | Aurness et al. | |
| 5,368,226 A | | 11/1994 | Franceschino | |
| 5,492,272 A | | 2/1996 | Fewer | |
| 5,897,053 A | | 4/1999 | Cirimele | |
| 5,921,117 A | | 7/1999 | Illguth | |
| 5,954,264 A | | 9/1999 | Keller | |
| 6,109,519 A | | 8/2000 | McClure | |
| 6,318,628 B1 | | 11/2001 | Pangburn | |
| 6,378,767 B1 | * | 4/2002 | Steele | 232/19 |

* cited by examiner

*Primary Examiner*—William L. Miller
(74) *Attorney, Agent, or Firm*—Richard L. Miller, P.L.

(57) ABSTRACT

A mail receptacle. Exterior and interior portions are attached to opposing sides of a door. The exterior portion includes a first flap hingedly attached to the door and selectively closes a mail slot in the door, and an exterior receptacle affixed to the door and selectively closed by a second flap hingedly attached to the door. The interior portion includes an interior receptacle affixed to the door, communicates with the mail slot, and is selectively closed by a third flap hingedly attached to the door, and a clasp hingedly attached to the third flap and selectively overlying the interior receptacle. A padlock is welded to the clasp and a staple extends outwardly from the interior receptacle and is positioned to pass through the clasp, and after the staple passes through the clasp, the staple is engaged by the shackle of the padlock, and by closing the shackle, the interior portion becomes locked.

3 Claims, 2 Drawing Sheets

MAIL RECEPTACLE FOR ATTACHING TO A PERIPHERY OF A MAIL SLOT OF A DOOR

BACKGROUND OF THE INVENTION

1. Field of the Invention

The present invention relates to a mailbox. More particularly, the present invention relates to a mail receptacle for attaching to a periphery of a mail slot of a door.

2. Description of the Prior Art

Numerous innovations for mailboxes have been provided in the prior art that will be described. Even though these innovations may be suitable for the specific individual purposes to which they address, however, they differ from the present invention.

A FIRST EXAMPLE, U.S. Pat. No. 4,069,965 to Maddox, Jr. teaches a main plate A, having a letter-opening and provided with bosses b, and with a portion, E, having an opening, e, which receives a screw, the projecting head of which receives the blow of the knocker and sustains the wear resulting from the said stroke, the name-plate hinged to plate A and having their a portion, I, and the bolts having their points fitted to be threaded into bosses b and their heads constructed to receive the letter bag.

A SECOND EXAMPLE, U.S. Pat. No. 4,069,965 to Maddox, Jr. teaches a mail slot pouch assembly that comprises a supporting bracket which is fixed to planar surfaces surrounding a mail slot in a building door, a framework and a transparent plastic bag secured to the framework, and a framework being removably supported by the bracket and positioned to receive mail therethrough into the bag to prevent the same from falling on the building floor adjacent the door.

A THIRD EXAMPLE, U.S. Pat. No. 4,776,512 to Moore, Sr. et al. teaches a mail receptacle in the form of a pouch which attaches to the periphery of a mail slot on the interior of a door or wall of a residence or building to receive mail therein which is inserted through the slot. Part or all of the pouch material is transparent to provide a visual indication of mail delivery. A zipper opening is provided in the pouch to retrieve delivered mail from the pouch. A flap is provided as extra protection against air drafts.

A FOURTH EXAMPLE, U.S. Pat. No. 4,815,656 to Smith et al. teaches a rural mailbox indicator and security lock including an elongated rod designed to be moved between three positions, a first position indicating that the box is unlocked but no mail is there for pick-up, a second position wherein the box is open and mail is in the box to be picked up and a third position indicating that the box is securely locked against unauthorized entry. The elongated rod is rotatably mounted on a cam which is adjacent a locking mechanism, with the cam having a cut out portion designed to receive a latch of the locking mechanism in the third mentioned position of the elongated rod described above, with the cam further including an arcuate rim designed to inter-engage with a catch formed on the mail box door so that in the position of the elongated rod corresponding to locked condition, the door is prevented from being opened until the locking mechanism is released by a key.

A FIFTH EXAMPLE, U.S. Pat. No. 4,826,075 to Burns teaches the invention relates to receptacles for the collection of mail and more specifically to the collection of mail through a mail slot. According to the invention there is provided a mail receptacle means assembly consisting of a rectangular open weave basket with open top and having means for mounting to a bracket fixed to a door just below a mail slot. The receptacle means is mounted in such a way that the door can be of the overhead type such as a garage door so that it can be moved from the vertical to the horizontal orientation. The mail receptacle means and its mounting are designed to allow the receptacle means to maintain its orientation such that the open top of the receptacle means faces the ceiling no matter what position the door is in. The mail receptacle means mounting is designed also to allow the receptacle means to be removed from the door for placing onto a desk or other mail sorting or collection location.

A SIXTH EXAMPLE, U.S. Pat. No. 5,082,169 to Aurness et al. teaches a mail box including a rectangular box with a receiver's door side-hinged and locked by a combination lock, to and within the frame of a bottom-hinged deliver door. The bottom-hinged delivery door is locked at the top and side and opened only by a delivery person with a special release tool which is thrust into a side chamber of the unit and forces a latch gate sideways which draws a latch from the side of the door and simultaneously transmits the force of the entrance, through tangential movement of a release rod, to an L-shaped connector to a release cable which extends through rollers to the top latch of the delivery door. Spring action automatically closes both latches. Supplemental brace hinges are included to enable the delivery door to be held rigidly horizontal when open. Automatic means to indicate a package has been delivered is provided by a signal finger out the front of the side chamber which is activated by connecting means to the release rod and is released by hand. Other hand operated signal means are provided to indicate, by an arm extending out the front or one extending out the top that there is a package or letter in the box. A letter signal wheel in the receiver's door, activated automatically by the letter slot, indicates a letter delivery by showing a certain color.

A SEVENTH EXAMPLE, U.S. Pat. No. 5,368,226 to Franceschino teaches a mail slot pouch apparatus for use with a door that has a mail slot therein. The apparatus includes a planar frame element for framing an interior opening of the mail slot. The planar frame element includes a plurality of frame apertures. Screws are employed for attaching the planar frame element through the frame apertures onto the door. A pouch assembly is attached to the door by the planar frame element. The pouch assembly includes a first opening which includes a pair of tubular edges which include a pair of rigid rods inserted into the tubular edges. The pouch assembly also includes a second opening which permits mail to be removed from the pouch assembly. The pouch assembly further includes a plurality of pouch apertures that are placed in registration with the frame apertures in the planar frame element for installation of the pouch assembly and the planar frame element onto the door by the fastening assemblies. The second opening may include a drawstring assembly located at a bottom of the assembly. The drawstring assembly includes a string and a lock element for locking the string in a predetermined position around the second opening. Alternatively, a zipper assembly may be located in the pouch assembly for permitting selective access to mail retained in the pouch assembly. The zipper assembly may be located on a sidewall of the pouch assembly.

A EIGHTH EXAMPLE, U.S. Pat. No. 5,492,272 to Fewer teaches a mail slot receiving device for capturing and retaining mail positioned through a mail slot. The inventive device includes a mounting assembly securable beneath a mail slot. A flexible receiving assembly is coupled to the mounting assembly for receiving mail positioned through the mail slot. The receiving assembly will flexibly deform to retain mail therewithin during movement of the device such as occurs when the device is secured to a garage door.

AN NINTH EXAMPLE, U.S. Pat. No. 5,897,053 to Cirimele teaches a mail slot box includes a bottom, opposite sides, a semi-circular back, and an open top. A mounting flange extends along the front edges of the bottom and sides for mounting behind a mail slot and collecting mail delivered therethrough. The semi-circular back causes the mail to rotate and stack in an orderly fashion without binding or bunching up. When mounted behind a mail slot on a garage door, the semi-circular back provides a concave surface for holding the mail and preventing it from falling out when the garage door is lifted to a horizontal open position.

A TENTH EXAMPLE, U.S. Pat. No. 5,921,117 to Illguth teaches a locking receptacle and a locking device for securing a mailbox, package delivery box, or other receptacle requiring a single opening of the receptacle door for a mail person or package delivery person to insert a package being delivered and upon subsequent closing of the door locking until unlocked by a person having a key or combination therefor to receive the delivery. The locking device mounts to the inside of the receptacle and has an arm which is pivotally attached to the door of the receptacle and to a reciprocally pivotal locking disk. A first pivoting lever is positioned to engage a slot in the periphery of the locking disk when the door is closed so as to restrain the locking disk and the door in a closed position. A spring-biased, reciprocally pivotal counting disk is arranged to turn with the locking disk as the door is opened and to lock in that position by means of a second pivoting lever which engages a slot in the periphery of the counting disk. The first and second levers are interconnected such that the first lever will engage the slot in the locking disk when the door is closed only when the second lever is engaged in the slot in the counting disk. A key or combination type lock has a movable reset arm which when in the unlocked position contacts both levers to remove them from engagement with their respective slots to reset the locking device and upon moving to the locked position arms the locking device for subsequent single opening and closing operation of the receptacle door. Versions having linear acting locking and counting members are disclosed which operate similarly.

AN ELEVENTH EXAMPLE, U.S. Pat. No. 5,954,264 to Keller teaches a mailbox has a housing with an internal chamber for receiving mail and a mailbox door attached for movement with respect to the housing between a closed position for enclosing the internal chamber and an open position for exposing the internal chamber. A door actuating mechanism is attached to the mailbox and is operable to assist in remotely opening and closing the door by a mail carrier. The door actuating mechanism includes a transmitter, a door mounting section connected to the door; an electrical actuator body fixed with respect to the mailbox housing; and an actuator shaft mounted for movement with respect to the actuator body. The shaft has a proximal end portion movably mounted in the actuator body and a distal end portion connected to the door mounting section for opening and closing the door upon movement of the shaft. A receiver is electrically coupled to the actuator for causing the actuator to open or close the mailbox door upon receipt of a signal from the transmitter. A signal flag is pivotally attached to the mailbox housing at a pivot joint and includes a lower portion that extends below the pivot joint when the flag is in a raised position. A flag lowering mechanism has a first end connected to the door for movement therewith and a second end for engagement with the lower portion of the flag. With this arrangement, movement of the door from the closed position to the open position causes the second end to engage and push against the lower end of the flag to thereby pivot the flag to a lowered position. A hollow base supports the mailbox and houses the receiver and actuator body. A battery pack is located within the hollow base for providing electrical power to the receiver and actuator body. The battery pack can be recharged by a solar panel mounted at an upper end of the base. A signal light can be provided on the mailbox to supplement or replace the signal flag.

A TWELFTH EXAMPLE, U.S. Pat. No. 6,109,519 to McClure teaches a modular precast decorative security mailbox column has a base, a midsection, and a top section stacked on one another to define a completed column. The midsection of the column defines an interior compartment and mail deposited through the mail receptacle of the column falls into the interior compartment where it can be retrieved through a rear door in the midsection. The decorative mailbox column is thus economical to install, attractive in appearance, and provides security and privacy against thief and mail tampering.

A THIRTEENTH EXAMPLE, U.S. Pat. No. 6,318,628 B1 to McClure teaches a single-door locking mailbox that includes a housing having an open end and a door pivotally mounted to the housing for closing and opening the end. The door can be fully open, near closed but not locked or fully closed. A locking assembly, with a latch which can be placed in either the locked or unlocked position with a key, is attached to the door. A catch is attached at one end to the inside of the enclosure and has a camming surface and a hole at the free end. The camming surface deflects the catch over the latch when the door is pushed closed. The hole in the catch is positioned and configured so that it captures the locked latch when the door is pushed fully closed. The catch is resilient enough to be elastically deflected over the latch. A guard over the latch shields it from being deflected by a finger or tool inserted through the mail slot by a thief. The pivot axis of the door is located with respect to the center of gravity of the door assembly so that the door is held in the closed but not locked position by gravity. The geometry of the latch and catch are such that the closing force produced by gravity can not overcome the resistance produced by the latch and catch so the door does not spontaneously move to the locked position. After the mail has been deposited, the mail carrier pushes the door fully closed which causes it to reach the locked position.

It is apparent that numerous innovations for mailboxes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a mail receptacle for attaching to a periphery of a mail slot in a door that avoids the disadvantages of the prior art.

ANOTHER OBJECT of the present invention is to provide a mail receptacle for attaching to a periphery of a mail slot in a door that is simple and inexpensive to manufacture.

STILL ANOTHER OBJECT of the present invention is to provide a mail receptacle for attaching to a periphery of a mail slot in a door that is simple to use.

BRIEFLY STATED, STILL YET ANOTHER OBJECT of the present invention is to provide a mail receptacle. Exterior and interior portions are attached to opposing sides of a door. The exterior portion includes a first flap hingedly attached to the door and selectively closes a mail slot in the door, and an exterior receptacle affixed to the door and selectively closed by a second flap hingedly attached to the door. The interior portion includes an interior receptacle affixed to the door, communicates with the mail slot, and is selectively closed by a third flap hingedly attached to the door, and a clasp hingedly attached to the third flap and selectively overlying the interior receptacle. A padlock is welded to the clasp and a staple extends outwardly from the interior receptacle and is positioned to pass through the clasp, and after the staple passes through the clasp, the staple is engaged by the shackle of the padlock, and by closing the shackle, the interior portion becomes locked.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
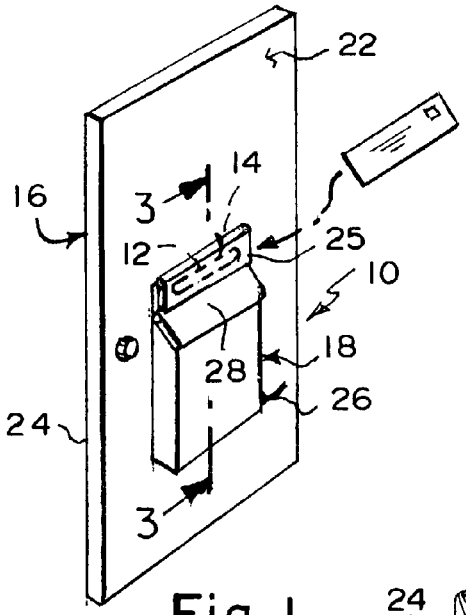
FIG. 1 is a diagrammatic perspective view of an exterior portion of a mail receptacle of the present invention attached to a periphery of a mail slot on an exterior of a door.

10 mail receptacle of present invention for attaching to periphery 12 of mail slot 14 in door 16
12 periphery of mail slot 14 in door 16
14 mail slot in door 16
16 door
18 exterior portion for attaching to periphery 12 of mail slot 14 on exterior 22 of door 16
20 interior portion for attaching to periphery 12 of mail slot 14 on interior 24 of door 16
22 exterior of door 16
24 interior of door 16
25 first flap of exterior portion 18 for hingedly attaching to exterior 22 of door 16 and for selectively closing mail slot 14 in door 16 from exterior 22 of door 16
26 exterior receptacle of exterior portion 18 for affixing to exterior 22 of door 16 and for holding papers, magazines, and like
28 second flap of exterior portion 18 for hingedly attaching to exterior 22 of door 16
30 interior receptacle of interior portion 20 for affixing to interior 22 of door 16 and for communicating with mail slot 14 in door 16
32 third flap of interior portion 20 for hingedly attaching to interior 24 of door 16
34 front face of interior receptacle 30 of interior portion 20
35 distal end of third flap 32 of interior portion 20
36 clasp of interior portion 20
38 padlock of clasp 36 of interior portion 20
40 shackle of padlock 38 of clasp 36 of interior portion 20
42 staple of interior receptacle 30 of interior portion 20

DETAILED DESCRIPTION OF THE PREFERRED EMBODIMENT

Figure 2:
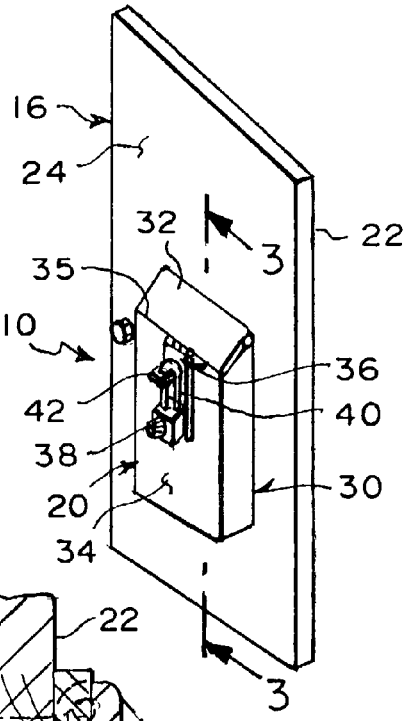
FIG. 2 is a diagrammatic perspective view of an interior portion of a mail receptacle of the present invention attached to a periphery of a mail slot on an interior of a door.

Referring now to the figures, in which like numerals indicate like parts, and particularly to FIGS. 1 and 2, the mail receptacle of the present invention is shown generally at 10 for attaching to a periphery 12 of a mail slot 14 in a door 16.

Figure 3:
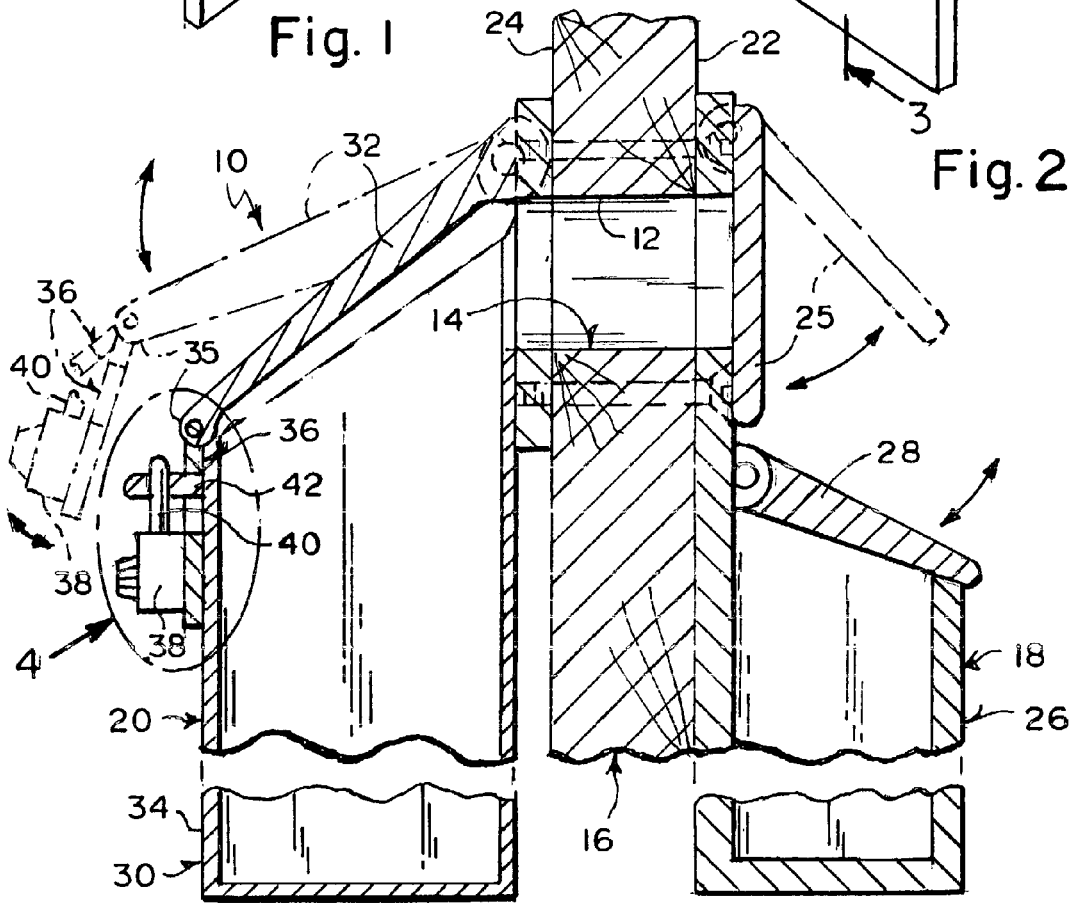
FIG. 3 is an enlarged diagrammatic cross sectional view taken along line 3—3 in FIGS. 1 and 2 of the present invention in toto.
Figure 4:
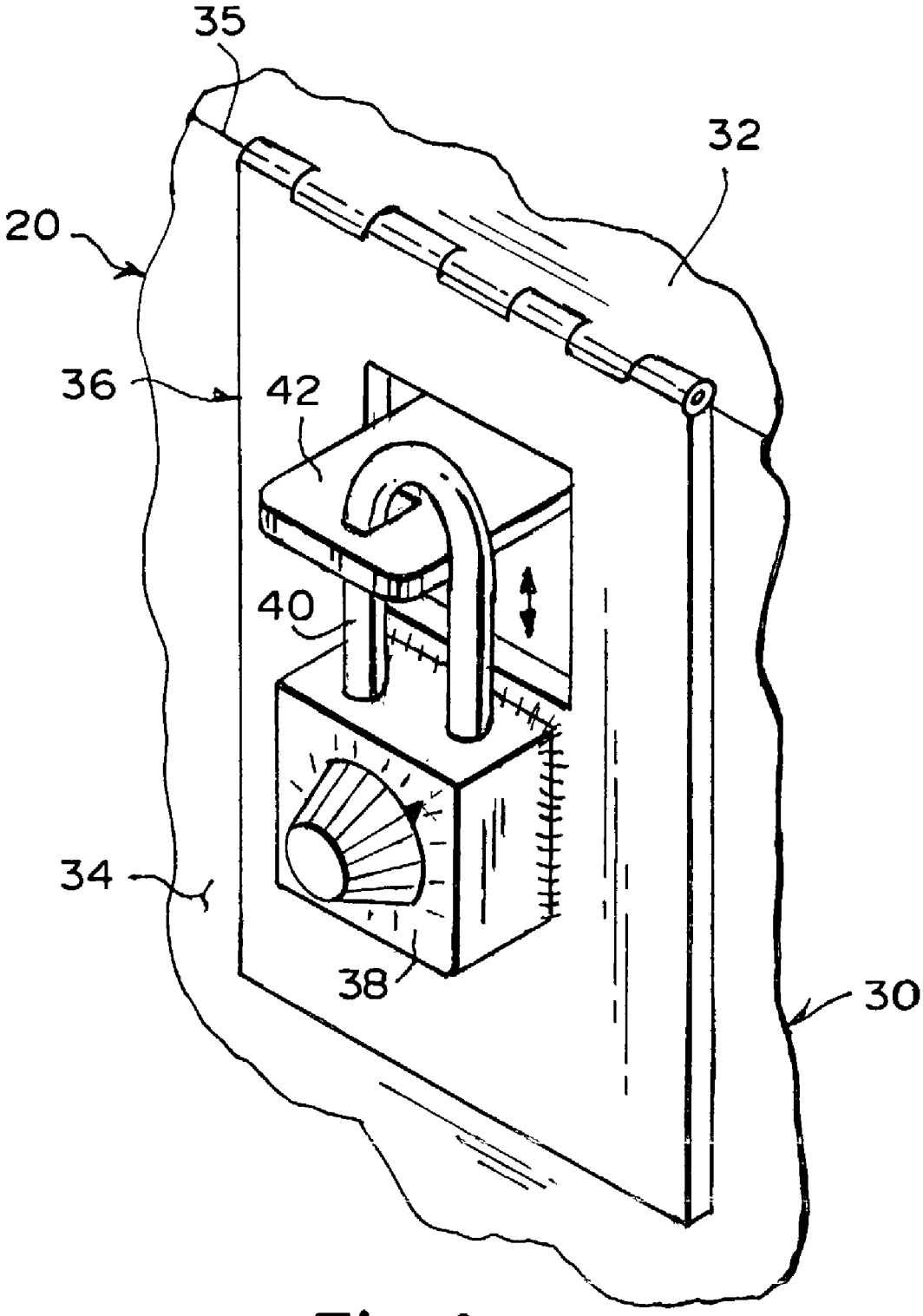
FIG. 4 is an enlarged diagrammatic perspective view of the area generally enclosed by the dotted curve identified by arrow 4 in FIG. 3 of the lock assembly of the interior portion of the mail receptacle of the present invention.

The configuration of the mail receptacle 10 can best be seen in FIGS. 3 and 4, and as such, will be discussed with reference thereto.

The mail receptacle 10 comprises an exterior portion 18 and an interior portion 20. The exterior portion 18 is for attaching to the periphery 12 of the mail slot 14, on an exterior 22 of the door 16. The interior portion 20 is for attaching to the periphery 12 of the mail slot 14, on an interior 24 of the door 16.

The exterior portion 18 comprises a first flap 25. The first flap 25 of the exterior portion 18 is for hingedly attaching to the exterior 22 of the door 16, and is for selectively closing the mail slot 14 in the door 16, from the exterior 22 of the door 16.

The exterior portion 18 further comprises an exterior receptacle 26. The exterior receptacle 26 of the exterior portion 18 is disposed below the first flap 24 of the exterior portion 18, and is for affixing to the exterior 22 of the door 16 and is for holding papers, magazines, and the like.

The exterior receptacle 26 of the exterior portion 18 is selectively closed by a second flap 28. The second flap 28 is for hingedly attaching to the exterior 22 of the door 16.

The interior portion 20 comprises an interior receptacle 30. The interior receptacle 30 of the interior portion 20 is for affixing to the interior 22 of the door 16 and is for communicating with the mail slot 14 in the door 16.

The interior receptacle 30 of the interior portion 20 is selectively closed by a third flap 32. The third flap 32 is for hingedly attaching to the interior 24 of the door 16.

The interior receptacle 30 of the interior portion 20 has a front face 34 and the third flap 32 of the interior portion 20 has a distal end 35.

The interior portion 20 further has a clasp 36. The clasp 36 of the interior portion 20 is hingedly attached to the distal end 35 of the third flap 32 of the interior portion 20, and selectively overlies the front face 34 of the interior receptacle 30 of the interior portion 20.

The clasp 36 of the interior portion 20 has a padlock 38 with a shackle 40. The padlock 38 is welded to the clasp 36 of the interior portion 20, with the shackle 40 of the padlock 38 extending upwardly.

The interior receptacle 30 of the interior portion 20 further has a staple 42. The staple 42 of the interior receptacle 30 extends outwardly from the front face 34 of the interior receptacle 30, and is positioned to pass through the clasp 36 of the interior portion 30 when the clasp 36 of the interior portion 20 overlies the front face 34 of the interior receptacle 30 of the interior portion 20. After the staple 42 of the interior receptacle 30 passes through the clasp 36 of the interior portion 30, the staple 42 of the interior receptacle 30 is engaged by the shackle 40 of the padlock 38, and by closing the shackle 40 of the padlock 38, the interior portion 20 becomes locked.

It will be understood that each of the elements described above, or two or more together, may also find a useful application in other types of constructions differing from the types described above.

While the invention has been illustrated and described as embodied in a mail receptacle for attaching to a periphery of a mail slot in a door, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A mail receptacle for attaching to a periphery of a mail slot in a door, wherein the door has an exterior and an interior, said receptacle comprising:

a) an exterior portion; and b) an interior portion;

wherein said exterior portion is for attaching to the periphery of the mail slot, on the exterior of the door; and wherein said interior portion is for attaching to the periphery of the mail slot, on the interior of the door, wherein said exterior portion comprises a first flap;

wherein said first flap of said exterior portion is for hingedly attaching to the exterior of the door; and wherein said first flap of said exterior portion is for selectively closing the mail slot in the door, from the exterior of the door, wherein said exterior portion comprises an exterior receptacle;

wherein said exterior receptacle of said exterior portion is disposed below said first flap of said exterior portion;

wherein said exterior receptacle of said exterior portion is for affixing to the exterior of the door; and wherein said exterior receptacle of said exterior portion is for holding papers, magazines, and similar articles, wherein said exterior receptacle of said exterior portion is selectively closed by a second flap; and wherein said second flap is for hingedly attaching to the exterior of the door.

2. A mail receptacle for attaching to a periphery of a mail slot in a door, wherein the door has an exterior and an interior, said receptacle comprising:

a) an exterior portion; and b) an interior portion;

wherein said exterior portion is for attaching to the periphery of the mail slot, on the exterior of the door; and wherein said interior portion is for attaching to the periphery of the mail slot, on the interior of the door, wherein said interior portion comprises an interior receptacle;

wherein said interior receptacle of said interior portion is for affixing to the interior of the door; and wherein said interior receptacle of said interior portion is for communicating with the mail slot in the door, wherein said interior receptacle of said interior portion is selectively closed by a third flap; and wherein said third flap of said interior portion is for hingedly attaching to the interior of the door, wherein said interior receptacle of said interior portion has a front face; and wherein said third flap of said interior portion has a distal end, wherein said interior portion has a clasp;

wherein said clasp of said interior portion is hingedly attached to said distal end of said third flap of said interior portion; and wherein said clasp of said interior portion selectively overlies said front face of said interior receptacle of said interior portion, wherein said clasp of said interior portion has a padlock;

wherein said padlock of said clasp of said interior portion has a shackle;

wherein said padlock is welded to said clasp of said interior portion; and wherein said shackle of said padlock extends upwardly.

3. The receptacle as defined in claim 2, wherein said interior receptacle of said interior portion has a staple;

wherein said staple of said interior receptacle extends outwardly from said front face of said interior receptacle;

wherein said staple of said interior receptacle is positioned to pass through said clasp of said interior portion when said clasp of said interior portion overlies said front face of said interior receptacle of said interior portion; and wherein after said staple of said interior receptacle passes through said clasp of said interior portion, said staple of said interior receptacle is engaged by said shackle of said padlock, and by closing said shackle of said padlock, said interior portion becomes locked.

* * * * *